US006153265A

United States Patent [19]

Tomaru et al.

[11] Patent Number: 6,153,265

[45] Date of Patent: Nov. 28, 2000

[54] EXTRUSION-TYPE COATING EQUIPMENT FOR UNIFORMLY APPLYING A COATING FLUID TO A SUPPORT SURFACE

[75] Inventors: Mikio Tomaru; Norio Shibata; Shinsuke Takahashi; Akihiro Suzuki, all of Kanagawa, Japan

[73] Assignee: Fuji Photo Film Co., Ltd., Kanagawa, Japan

[21] Appl. No.: 08/325,476

[22] Filed: Oct. 19, 1994

[30] Foreign Application Priority Data

Oct. 19, 1993 [JP] Japan ..... 5-283833

[51] Int. Cl.[7] ..... B05D 3/12; B05C 3/12

[52] U.S. Cl. ..... 427/356; 118/410; 118/411

[58] Field of Search ..... 118/410, 411; 427/356

[56] References Cited

U.S. PATENT DOCUMENTS

| | | | |
|---|---|---|---|
| 4,907,530 | 3/1990 | Shibata et al. | 118/410 |
| 5,099,786 | 3/1992 | Shibata et al. | 118/410 |
| 5,167,712 | 12/1992 | Shibata et al. | 118/410 |
| 5,435,847 | 7/1995 | Shibata et al. | 118/410 |

*Primary Examiner*—Katherine A. Bareford
*Attorney, Agent, or Firm*—Sughrue, Mion, Zinn, Macpeak & Seas, PLLC

[57] ABSTRACT

Coating equipment 20 with an extrusion type coating head comprising a back edge 6 having a top side which slopes away from a support from the height of the top of a front edge 5, a coating fluid spouting slot 4 defined by both the edges, and guide plates for regulating the width of a coating fluid spouted from the slot tip on both side ends of the slot for applying the coating fluid to the support surface from the slot 4 in a non-pressurized condition. The nearest point to the support surface in the slot corresponding portion of the upper edge of the guide plate 7 is positioned slightly upstream from the center line of the width of the slot along the support running direction and the area given by the product of the distance between the nearest point and the support surface and the width of the slot is made a specific value or less. The coating equipment thus formed has no risk of damaging the support and effectively lessens the effect of air entering from both end sides of an application point of a coating fluid during a high speed thin coat application and produces no film cut when the coating fluid is applied to the running support surface by non-pressurization type coating equipment.

20 Claims, 4 Drawing Sheets

EXTRUSION-TYPE COATING EQUIPMENT FOR UNIFORMLY APPLYING A COATING FLUID TO A SUPPORT SURFACE

BACKGROUND OF THE INVENTION

1. Field of the Invention

This invention relates to coating equipment using an extrusion type coating head for uniformly applying a coating fluid to the surface of a continuously running belt-like support, and more particularly to extrusion type coating equipment for uniformly applying a coating fluid to a support surface in a non-pressurized condition when the coating fluid is coated to the support surface from a slot.

2. Description of the Related Art

Hitherto, a step of applying a desired coating fluid to the surface of a flexible support has been executed in a manufacturing process of photo-sensitive material, magnetic recording media, etc. Coating fluids containing various fluid compositions are available according to their applications. For example, coating fluids of photo-sensitive emulsion coats, undercoats, protective coats, back coats, etc., are available for photo-sensitive material and magnetic coats, undercoats, protective coats, lubricant coats, etc., are available for magnetic recording media. The coating fluids are aqueous solutions, organic solvent solutions, etc., containing essential components, binders, and various admixtures as required.

Hitherto, various application methods, such as a roll coat method, a gravure coat method, a roll coat plus doctor method, extrusion type application method, and slide coat method, have been used as methods of applying such coating fluids to the flexible support surface. In recent years, an application method using an extrusion type coating head has been often used for applying a magnetic coating fluid.

A typical method using an extrusion type coating head is, as well known, a method of applying a thin and uniform coating of fluid extruded from the slot end to the surface of a continuously running flexible support with the coating head disposed between a pair of run guide means spaced at a given distance apart at a predetermined location on which the flexible support is placed.

Coating equipment using the extrusion type coating head is disclosed, for example, in Japanese Patent Laid-Open No.Sho 63-20069. As shown in JPA1069, the coating equipment comprises a coating head disposed between support guide means (rollers), the coating head comprising a front edge positioned upstream with respect to the running direction of a support, a back edge positioned downstream sloped in the direction opposite to the support so that the top of the back edge recedes from the top of the front edge, a coating fluid spouting slot defined by both the edges, and coating width regulation plates on both sides of the slot for regulating the width of a coating fluid spouted from the slot tip. In the application step using the coating equipment, part of a low-viscosity fluid previously applied to the support is scraped out by the front edge in order to completely exclude air accompanying the support, so that the coating fluid spouted out from the slot tip can be applied to the support surface in a non-pressurized condition.

However, if an attempt is made to apply a uniformly thick coating of coating fluid to the running support surface with the non-pressurized extrusion type coating head, a phenomenon called "film cut" occurs on both side ends of the coat (left and right ends in the direction perpendicular to the running direction of the support). The film cut is described in conjunction with FIG. 12 which is a sectional view of a part cut along the slot of the coating head. The running direction of the support is a direction perpendicular to the plane of the paper and directed from downward to upward. As shown in FIG. 12, coating fluid 36 is continuously supplied from the bottom in the figure through the slot to the surface of the support 30 to which precoat 35 has already been applied.

At this time, the front of the coating fluid 36 is liquid-sealed by the precoat 35, but an opening is made between the upper edges of coating width regulation plates 7 and the support 30 on both left and right ends. Air pressure entering through the part causes film cut 38 to develop between the coating fluid 36 and the precoat 35. In the application method in which large application pressure is not produced when the coating fluid 36 is applied, the film cut 38 appears as a thin coat is applied at high speed.

The coating width regulation plates 7 may be brought nearer to the support 30 for preventing air from entering. However, as the upper edges of the coating width regulation plates 7 are brought near the support 30, the risk of the coating width regulation plates 7 contacting the support and damaging it is increased. Particularly when the coating width regulation plates 7 are made of metal, the support is damaged severely.

SUMMARY OF THE INVENTION

It is therefore an object of the invention to provide coating equipment which does not damage a support and effectively lessens the effect of air entering from both end sides of an application point of a coating fluid during high speed application of a thin coat and which does not produce a film cut when the coating fluid is applied to the running support surface by non-pressurized type coating equipment.

To that end, according to the invention, there is provided coating equipment with an extrusion type coating head disposed between run guide means spaced at a predetermined distance apart and facing a continuously running support retained by the run guide means. The coating head comprises a front edge positioned upstream with respect to the running direction of the support, a back edge positioned downstream sloping in the direction opposite the support so that the top of the back edge recedes from the top of the front edge, a coating fluid spouting slot defined by both edges, and coating width regulation plates for regulating the width of a coating fluid spouted from the slot tip on both side ends of the slot for applying the coating fluid to the support surface from the slot in a non-pressurized condition in a liquid seal state while scraping out part of a low-viscosity fluid previously applied to the support by the front edge, wherein the nearest point to the support surface in the portion of the upper edge of the coating width regulation plate which corresponds to the slot is positioned slightly upstream from the center line of the width of the slot along the support running direction and an area given by the product of the distance between the nearest point and the support surface and the width of the slot is 1 $mm^2$ to $6\times10^{-5}$ $mm^2$, more preferably 0.1 $mm^2$ to $1.2\times10^{-4}$ $mm^2$, and the most preferably $8\times10^{-3}$ $mm^2$ to $1\times10^{-3}$ $mm^2$.

The nearest point of the coating width regulation plate can be positioned on the rear end wall of the front edge with a linear slant from the nearest point to the front end wall of the back edge.

The upper edge in the portion of the coating width regulation plate which corresponds to the slot can be made planar and parallel to the support surface.

The nearest point of the coating width regulation plate can be positioned slightly upstream from the center line and the upper edge of the coating width regulation plate can be formed substantially like a wave with an offset crest ((^)) with the nearest point as the curve vertex.

The nearest point of the coating width regulation plate can be positioned slightly upstream from the center line and the upper edge of the coating width regulation plate can be formed as a curve having the nearest point as the vertex and advancing to the support surface side.

DETAILED DESCRIPTION OF THE PREFERRED EMBODIMENTS

Referring now to the accompanying drawings, preferred embodiments of the invention will be described.

Figure 1:
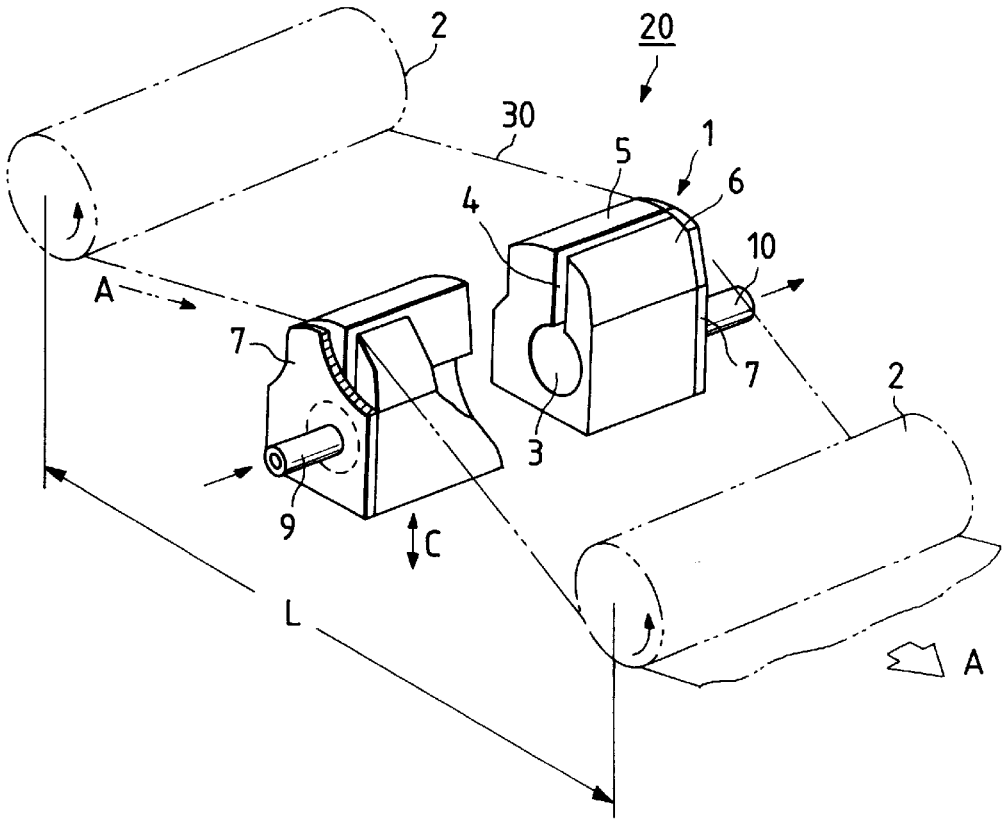
FIG. 1 is a perspective view of the main parts of the coating equipment according to the invention.
Figure 2:
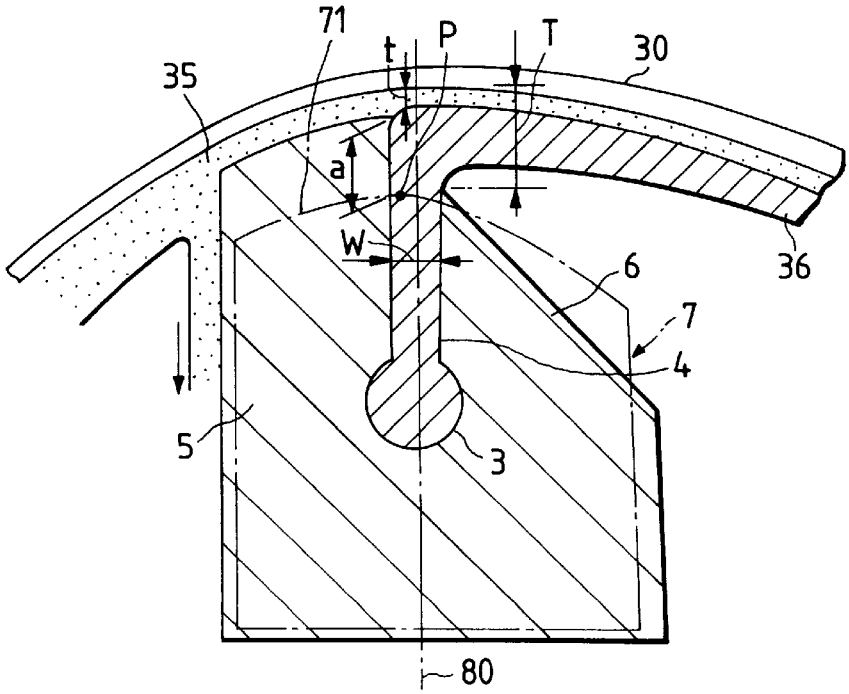
FIG. 2 is a sectional view of the principle components of the coating equipment showing a state in which a continuously running support is passed over the coating head shown in FIG. 1 and coating fluid is applied to the support.
Figure 3:
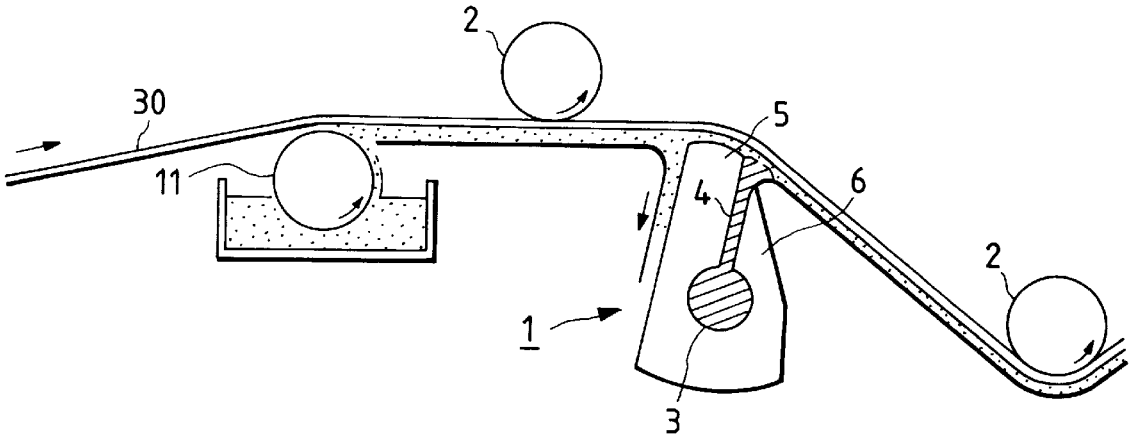
FIG. 3 is a schematic drawing of the main parts of coating equipment also containing an application step wherein a precoat is applied to the support which is passed over the coating head shown in FIG. 1.
Figure 4:
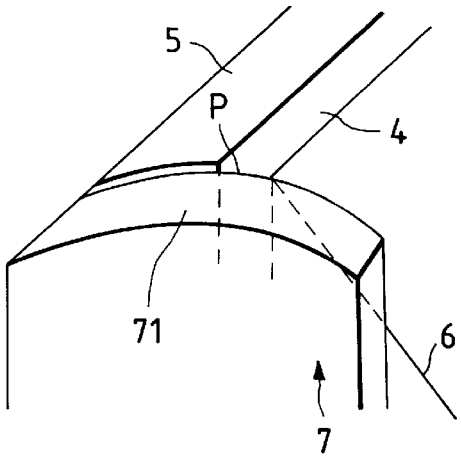
FIG. 4 is an enlarged perspective view of the main parts of the coating equipment shown in FIG. 1.

FIG. 1 is a partially cutaway view in perspective of a coating head 1 for applying a lamination of coating fluid to the surface of a support 30 to which a precoat fluid 35 (see FIG. 3) has been previously applied. Generally, the precoat fluid has a thickness of 0.3 $\mu$m to 4 $\mu$m. FIG. 2 is a sectional view of the principle components of the coating head shown in FIG. 1 showing an application operation. FIG. 3 is a schematic drawing of an application step showing how the precoat fluid is applied.

Coating equipment 20 shown in FIG. 1 is used with facilities for manufacturing magnetic recording media such as magnetic tape, wherein a support 30 is placed on a pair of guide rollers 2, 2 spaced a given distance L apart for continuous running in the A direction from upstream to downstream. The coating head 1, which has a slot 4 for spouting a coating fluid of magnetic dispersion, is disposed on the opposite side of the guide rollers 2, 2 with respect to the support so that the tip of the slot 4 faces the support surface.

A fluid reservoir 3 linked with the slot 4 is formed in the body of the coating head 1. Coating width regulation plates 7 and 7 for blocking both ends of the slot 4 and the fluid reservoir 3 are located on both ends of the coating head 1. A pipe for supplying coating fluid (not shown) is connected to a short pipe 9 attached to the coating width regulation plate 7 and coating fluid 36 is supplied from the short pipe 9 to the fluid reservoir 3. A proper amount of coating fluid is removed from a short pipe 10 connected to the coating width regulation plate 7 on the opposite side, thereby equalizing the pressure of fluid spouted out from the slot and preventing the fluid from collecting.

The coating width regulation plate 7 has a structure which does not encroach on the slot and which blocks the slot from the side.

The coating head 1 is able to move on a support base toward the support 30 and away from support 30 (arrow C) by the operation of a moving device provided with a drive system such as an air cylinder (not shown).

The coating head 1 comprises a front edge 5 positioned upstream with respect to the running direction of the support 30 and a back edge 6 positioned downstream, as shown in FIG. 2. The front edge 5 is formed so that the entire edge face opposed to the support 30 advances toward the support 30 with a proper curvature.

The slot 4 for spouting a coating fluid defined by the front edge 5 and the back edge 6 is disposed between both the edges. The part of the back edge 6 nearest to the support 30 at the spout tip of the slot 4 forms an acute edge, and the edge top is formed sloping away from the support as the distance from the front edge 5 increases. When the coating fluid 36 is spouted out from the slot 4, it flows away from the sharp edge tip and is applied to the support surface in a non-pressurized condition.

As shown in FIG. 3, precoat fluid 35 is previously applied, for example, by means of a reverse roll 11, to the support 30 lapped in the coating head 1, and extra precoat fluid 35 is removed by the front edge 5 of the coating head 1. Then the coating fluid 36 spouted out from the slot 4 is laminated on the precoat fluid 35 passed through the front edge 5.

The width of the slot 4, w, can be set in the range of 1 mm to 0.1 mm, preferably 0.8 mm to 0.1 mm, and more preferably 0.6 mm to 0.15 mm. Point P, which is nearest to the support surface in the slot corresponding to a portion of the upper edge 71 of the coating width regulation plate 7, 7 for regulating the width of the coating fluid 36, is positioned slightly upstream from the center line 80 of the width of the slot 4 along the support running direction, thereby enabling the coating head 1 to block entering air from the lateral direction at a place very near the point at which the coating fluid 36 is laminated on the precoat fluid 35. This feature Ls extremely effective at preventing air from entering. The intensive research of the inventor on the position of the nearest point P shows that this effect is produced when the area given by the product of the distance between the nearest point P and the surface of the support 30, T, and the width of the slot 4, w, is 1 $mm^2$ to $6\times10^{-5}$ $mm^2$, more preferably 0.1 $mm^2$ to $1.2\times10^{-4}$ $mm^2$, and the most preferably $8\times10^{-3}$ $mm^2$ to $1\times10^{-3}$ $mm^2$.

As shown in FIG. 2, the distance between the nearest point P and the surface of the support 30, T, is the total dimension of the distance between the rear end of the top surface of the front edge 5 and the nearest point P, a, and the thickness of the precoat fluid 35, t. The value of the distance T can be set to 10 mm to $3\times10^{-4}$ mm, more preferably 1 mm to $5\times10^{-3}$ mm, and the most preferably 0.1 mm to $1\times10^{-2}$ mm. Therefore, the coating width regulation plate may be fixed at a position where the nearest point P recedes downward in millimeter units with respect to the top surface of the front edge 5, thereby allowing installation using a comparatively rough dimension. This can avoid projecting the coating width regulation plate 7 upward from the front edge 5 when the coating width regulation plate 7 is installed so that it is aligned with the top surface of the front edge 5, thereby inhibiting an installation error from lowering performance of the coating equipment.

According to the coating equipment 20 thus formed, when the coating fluid 36 is applied to the support surface, there is no risk of damaging the support 30. Also at high speed thin coat application, the effect of air entering from both end sides of the application point of the coating fluid 36 can be lessened effectively. Therefore, magnetic recording media formed with a good coat free of film cut can be manufactured.

Figure 5:
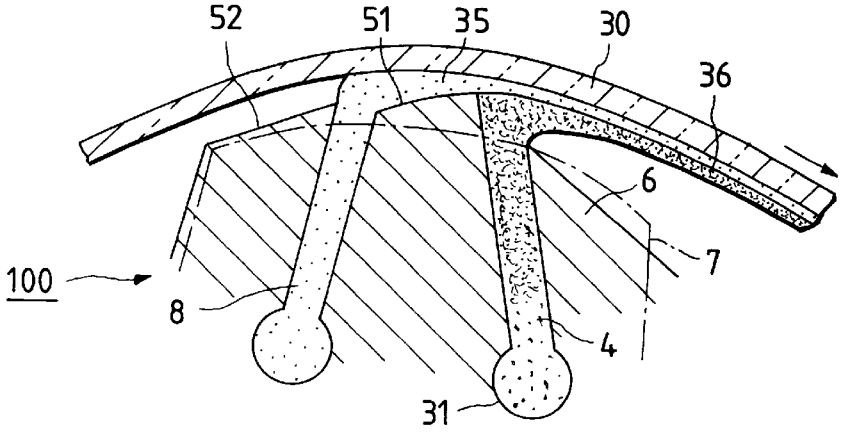
FIG. 5 is a sectional view of the main parts of another embodiment of the coating equipment of the invention.

The coating head in the invention is not limited to the device of the type wherein the precoat fluid 35 is previously applied to the surface of the support 30 with the reserve roll 11 as shown in FIG. 3. For example, a coating head 100 of a type which simultaneously applies multiple coats, as shown in FIG. 5, may be used wherein a precoat fluid 35 dispensed from a fluid reservoir 32 is spouted out from a slot 8 formed between front edges 52 and 51 positioned upstream of the running support 30 for applying the precoat 35 to the surface of the support 30. Immediately downstream from slot 8, a coating fluid 36 is spouted out from slot 4 between the front edge 51 and back edge 6 and is laminated on the precoat fluid 35.

Figure 6:
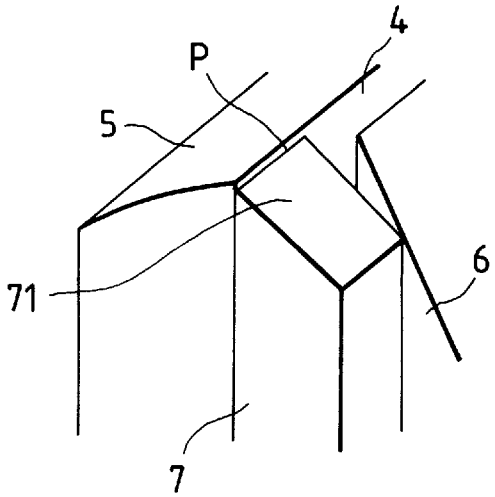
FIG. 6 is a sectional vie of the main parts of another embodiment of the coating equipment of the invention.
Figure 7:
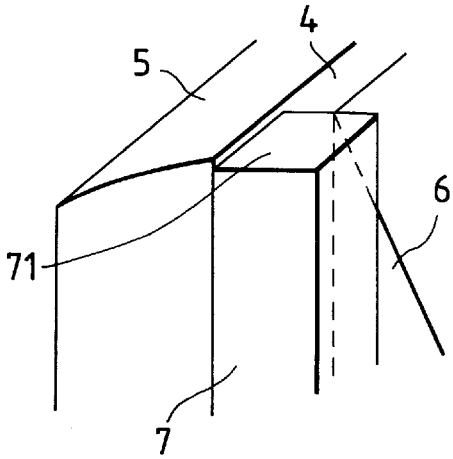
FIG. 7 is a sectional view of main parts of the another embodiment of the coating equipment of the invention.

In this embodiment, the upper edge of the coating width regulation plate 7 is formed as a curve having the nearest point P as the vertex and advancing to the support surface side which is the most preferred embodiment of this invention, but various forms can be adopted in the invention. For example, the following forms may be adopted: The form as shown in FIG. 6, wherein the nearest point P of the upper edge 71 in the portion of the coating width regulation plate 7 corresponding to the slot is positioned on the rear end wall of the front edge 5 with a linear slant from the nearest point P to the front end wall of the back edge 6, the present embodiment is preferable because a high machinary accuracy can be maintained; the form as shown in FIG. 7 wherein the upper edge 71 in the portion of the coating width regulation plate 7 corresponding to the slot lies in a plane parallel to the support surface; and the form wherein the nearest point P of the coating width regulation plate 7 is positioned slightly upstream from the center line 80 of the slot width and the upper edge 71 of the coating width regulation plate 7 is formed substantially like a wave with an offset crest ((^)) with the nearest point P as the curve vertex.

Figure 9:
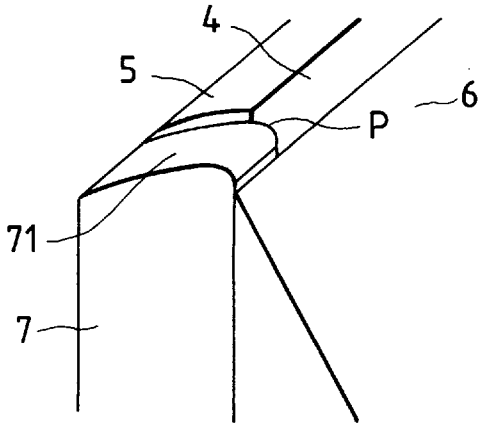
FIG. 9 is a sectional view of main parts of the another embodiment of coating equipment of the invention.

Further, in the curve form where the coating width regulation plate 7 advances upward, the coating width regulation plate 7 may be positioned on the front rather than the side of the back edge 6, for example, as shown in FIG. 9.

As described above, in coating equipment having an extrusion type coating head, the nearest point to the support surface in the portion of the upper edge of the coating width regulation plate for regulating the coating fluid width corresponding to the slot is positioned slightly upstream from the center line of the width of the slot along the running direction of the support and the area given by the product of the distance between the nearest point P and the support surface, T, and the width of the slot 4, w, is 1 $mm^2$ or less. Thus, coating equipment can be provided which blocks air from entering from the lateral direction at a location very near the point at which the coating fluid is applied and which does not damage the support when the coating fluid is applied to the support surface. The coating equipment also does not generate a film cut when a thin coat is applied at high speed.

EXAMPLES

The invention will be clearly described with reference to the following examples:

Components in the composition listed in Table 1 were put into a ball mill and fully mixed and dispersed. Then 30 parts by weight of epoxy resin (epoxy equivalent 500) were added and uniformly mixed and dispersed to generate a magnetic coating fluid.

TABLE 1

| | |
|---|---|
| $\gamma$-$Fe_2O_3$ powder | 300 parts by weight |
| Vinyl chloride-vinyl acetate copolymer (copolymer ratio 87:13, polymerization degree 400) | 30 parts by weight |
| Conductive carbon | 20 parts by weight |
| Polyamide resin (amine valence 300) | 15 parts by weight |
| Lecithin | 6 parts by weight |
| Silicone oil (dimethyl polysiloxane) | 3 parts by weight |
| Xylol | 300 parts by weight |
| Methyl isobutyl ketone | 300 parts by weight |
| n-butanol | 100 parts by weight |

Methyl isobutyl ketone was used for precoat fluid 35, and the bar coater method was used for application.

The coating fluid was applied by using the coating head shown in FIGS. 7 and 10 under the conditions mentioned below. The material of the support 30 to be coated was 15 micron thick polyethylene terephthalate film.

Example 1

The coating head 1 used in Example 1 has a structure having width regulation plates 7, each of which has a portion corresponding to the slot 4, and are installed on both side ends of slot 4. Each portion corresponding to the slot has an upper edge 71 at a given height and is defined by the front edge 5 and back edge 6, as shown in FIG. 10. Application was executed by changing the coating speed V, spout width w, distance T and coat thickness for a coating width of 500 mm in the following ranges: coating speed V ranging from 400 to 100 m/min, slot width w ranging from 1.0 to 0.1 mm, distance T ranging from −0.1 mm (in this case, a projection dimension from the front edge) to 10.008 mm, and thickness of precoat 35, t, 8.0 $\mu$m in an undry condition. The relationship between the opening area given by the product of the distance between the nearest point P and the support surface, T, and the width of the slot 4, w, and the thin film limit of the coat thickness was observed. The results are listed in Table 2.

TABLE 2

| Coating speed V (m/min) | Slit width w [mm] | Distance between nearest point and support surface, T(mm) | Opening area [$mm^2$] | Limit of coat thickness of coating fluid ($\mu$m) |
|---|---|---|---|---|
| 400 | 1.0 | 0.458 | 0.458 | 20.3 |
| 400 | 1.0 | 0.958 | 0.958 | 25.5 |
| 400 | 1.0 | 1.003 | 1.003 | Stable application possible |

TABLE 2-continued

| Coating speed V (m/min) | Slit width w [mm] | Distance between nearest point and support surface, T(mm) | Opening area [mm$^2$] | Limit of coat thickness of coating fluid ($\mu$m) |
|---|---|---|---|---|
| 400 | 0.5 | −0.100 | — | (Scratch occurrence) 13.2 |
| 400 | 0.5 | 0.000 | 0.000 | 16.2 |
| 400 | 0.5 | 2.000 | 1.000 | 23.7 |
| 100 | 0.5 | 2.010 | 1.005 | Stable application impossible |
| 100 | 0.5 | 0.000 | 0.000 | 17.5 |
| 100 | 0.5 | 2.000 | 1.000 | 25.0 |
| 100 | 0.5 | 2.010 | 1.005 | Stable application impossible |
| 100 | 0.1 | 0.000 | 0.000 | 20.2 |
| 100 | 0.1 | 9.950 | 0.950 | 26.9 |
| 100 | 0.1 | 10.050 | 1.005 | Stable application impossible |

The results listed in Table 2 show that when the opening area given by the product of the distance between the nearest point P and the support surface, T, and the width of the slot 4, w, exceeds 1.0 mm$^2$, film cut and non-uniform thickness which is apparently caused by film cut occurred frequently, drastically lowering the coat quality and impairing the application process.

Example 2

Figure 11:
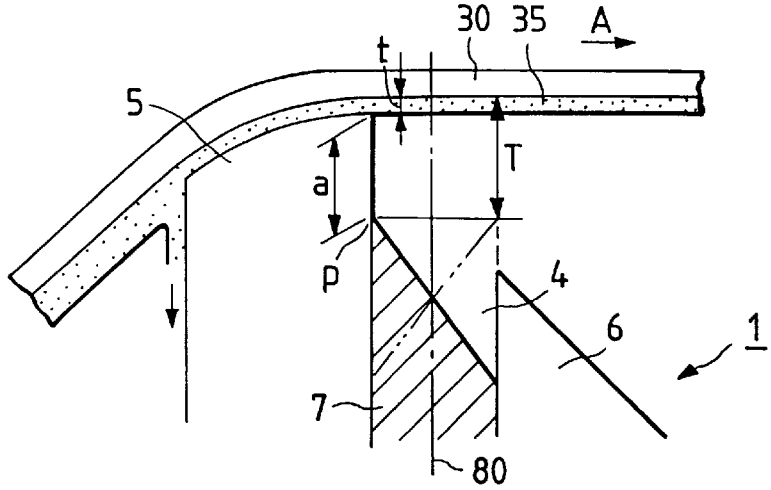
FIG. 11 is a sectional view of the main parts of the coating equipment used in another example of the invention.
Figure 12:
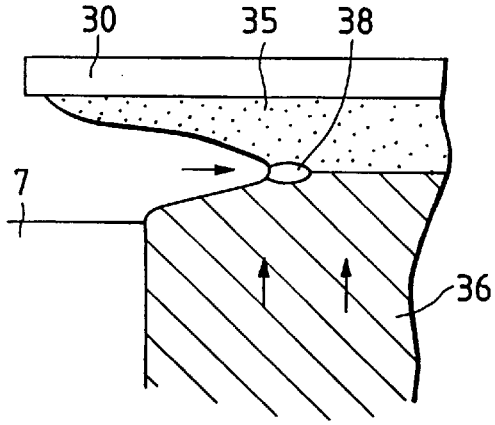
FIG. 12 PRIOR ART
FIG. 12 is a partial sectional view for showing a film cut of conventional coating equipment.

The coating head 1 used in Example 2 has a structure wherein the portion of each coating width regulation plate 7 corresponding to the slot has the point P nearest to the surface of the support 30, positioned on the boundary of the front edge 5 and having a linear slope inclining toward the back edge 6 from the front edge 5, as shown in FIG. 11. Application was executed by changing the coating speed V, spout width w, distance T and coat thickness under the following conditions: A coating width of 500 mm, coating speed V ranging from 800 to 200 m/min, slot width w ranging from 1.0 to 0.1 mm, distance T ranging from 0.00 to 10.051 mm, and thickness of precoat 35, t, 1.0 $\mu$m in an undry condition. The relationship between the opening area given by the product of the distance between the nearest point P and the support surface, T, and the width of the slot 4, w, and the thin film limit of the coat thickness was observed. The results are listed in Table 3.

TABLE 3

| Coating speed V (m/min) | Slit width w [mm] | Distance between nearest point and support surface, T(mm) | Opening area [mm$^2$] | Limit of coat thickness of coating fluid ($\mu$m) |
|---|---|---|---|---|
| 800 | 1.0 | 0.050 | 0.050 | 18.2 |
| 800 | 1.0 | 1.000 | 1.000 | 21.2 |
| 800 | 1.0 | 1.005 | 1.005 | Stable application impossible |
| 800 | 0.5 | 0.000 | 0.000 | 10.6 |
| 800 | 0.5 | 0.100 | 0.050 | 13.7 |
| 800 | 0.5 | 2.000 | 1.000 | 19.9 |
| 800 | 0.5 | 2.010 | 1.005 | Stable application impossible |
| 200 | 0.5 | 0.100 | 0.050 | 12.1 |
| 200 | 0.5 | 2.000 | 1.000 | 18.3 |
| 200 | 0.5 | 2.010 | 1.005 | Stable application impossible |
| 200 | 0.1 | 0.050 | 0.005 | 9.1 |
| 200 | 0.1 | 10.0 | 1.000 | 15.0 |

TABLE 3-continued

| Coating speed V (m/min) | Slit width w [mm] | Distance between nearest point and support surface, T(mm) | Opening area [mm$^2$] | Limit of coat thickness of coating fluid ($\mu$m) |
|---|---|---|---|---|
| 200 | 0.1 | 10.050 | 1.005 | Stable application impossible |

The results listed in Table 3 show that when the opening area exceeds 1.00 mm$^2$, stable application of the coating fluid is not possible.

Example 3

Figure 10:
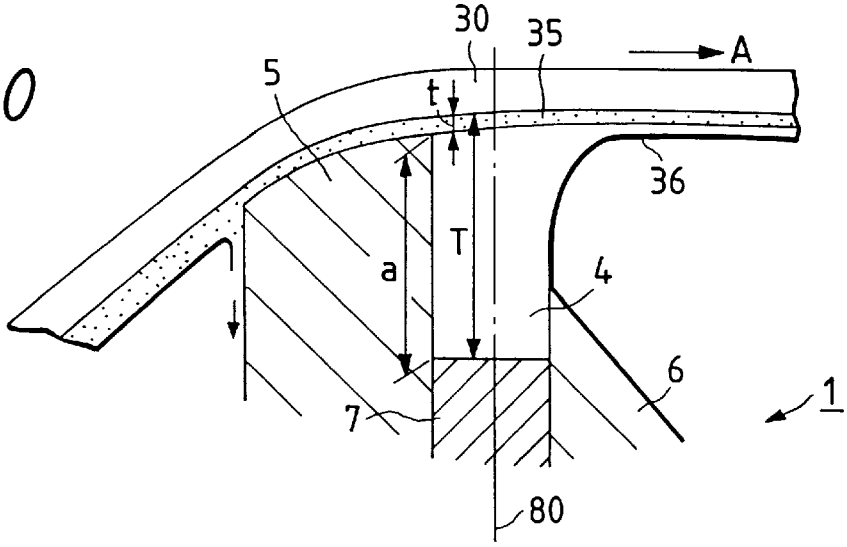
FIG. 10 is a sectional view of the main parts of coating equipment used in an example of the invention.

The coating head 1 used in Example 3 has the same basic structure as shown in FIGS. 10 and 11. The form of the portion of the coating width regulation plate 7 which corresponds to the slot was changed.

Figure 8:
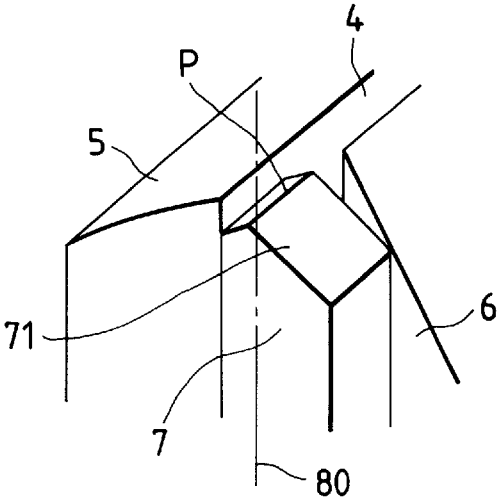
FIG. 8 is a sectional view of main parts of the another embodiment of the coating equipment of the invention.

The same application conditions used for Example 1 were used for samples 1 and 2. For sample 1, the coating speed was 400 m/min, the slot width 1.0 mm, the coat thickness 20.3 $\mu$m, and the distance between the nearest point and the support surface, T, 0.458 mm with the form of the coating width regulation plate 7 shown in FIG. 8. For sample 2, the same conditions were used as for sample 1, and the vertex of the curve was to the rear of the center line 80 (samples 1 and 2 are symmetrical with respect to the center line 80).

The same application conditions used for Example 2 were used for samples 3 and 4. For sample 3, the coating speed was 800 m/min, the slot width 1.0 mm, the coat thickness 18.2 $\mu$m, and the distance between the nearest point and the support surface, T, 0.051 mm with the form of the coating width regulation plate 7 shown in FIG. 11. For sample 4, with the same conditions as sample 3, the nearest point is to the rear of the center line 80 (the nearest point is on the back edge side as indicated by the imaginary line in FIG. 11).

The state of the coat of each sample was visually observed. The results are listed in Table 4.

TABLE 4

| Sample No. | Coating speed V (m/min) | Opening area [mm$^2$] | Observation of coat formation state with visual inspection |
|---|---|---|---|
| 1 | 400 | 0.458 | No film cut, good |
| 2 | 400 | 0.458 | Film cut, uneven thickness |
| 3 | 800 | 0.050 | No film cut, good |
| 4 | 800 | 0.050 | Film cut, uneven thickness |

The results listed in Table 4 show that when the nearest point exists upstream from the center line, good application results can be obtained.

What is claimed is:

1. A process of applying a coating fluid to a continuously running web with an extrusion coating head pushed against the running web at a position between two adjacent run-guide means for retaining the running web, said coating head comprising:

a front edge, a back edge positioned downstream with respect to a running direction of the web from said front edge and having an end opposite the web which slopes away from the web in the downstream direction, a coating fluid spouting slot, for spouting a coating fluid, defined by both of said edges, and coating width regulation plates for regulating a width of the coating fluid spouted from a tip of said slot, one of said plates disposed on each of two side ends of said slot for applying the coating fluid to a surface of the web from said slot in a non-pressurized condition in a liquid seal state while scraping off part of a viscous fluid previously applied to said web by said front edge, said process comprising the steps of:

positioning a nearest point to the web surface of a portion of an upper edge of said coating width regulation plate corresponding to said slot upstream from a center line of a width of said slot along the web running direction and such that an area given by a product of a distance between the nearest point and the web surface and the width of said slot is 1 mm to $6\times10^{-5}$ $mm^2$; and applying the coating fluid to the running web.

2. The process of claim 1, wherein the nearest point of said coating width regulation plate is positioned adjacent to an end wall of said front edge opposite said back edge, and said coating width regulation plate has a surface having a linear slant from the nearest point to an end wall of said back edge opposite said front edge.

3. The process of claim 1, wherein the nearest point of said coating width regulation plate is positioned upstream from the center line and the upper edge of said coating width regulation plate is formed as a curve with an offset crest with the nearest point as a curve vertex.

4. The process of claim 1, wherein said width of said slot is set in a range of 1 mm to 0.1 mm.

5. The process of claim 4, wherein said width of said slot is set in a range of 0.8 mm to 0.1 mm.

6. The process of claim 5, wherein said width of said slot is set in a range of 0.6 mm to 0.15 mm.

7. The process of claim 1, wherein a value of said distance is set to 10 mm to $3\times10^{-4}$ mm.

8. The process of claim 7, wherein said value of said distance is set to 1 mm to $5\times10^{-3}$ mm.

9. The process of claim 8, wherein said value of said distance is set to 0.1 mm to $1\times10^{-2}$ mm.

10. The process of claim 1, wherein said area is set within a range of 0.1 $mm^2$ to $1.2\times10^{-4}$ $mm^2$.

11. The process of claim 1, wherein said area is set within a range of $8\times10^{-3}$ $mm^2$ to $1\times10^{-3}$ $mm^2$.

12. Coating equipment with an extrusion coating head disposed between run guide means spaced a distance apart and facing a continuously running support retained by said run guide means, said coating head comprising:

a front edge, a back edge position downstream with respect to a running direction of the support from said front edge and having an end opposite the support which slopes away from the support in the downstream direction, a coating fluid spouting slot, for spouting a coating fluid, defined by both of said edges, and coating width regulation plates for regulating a width of the coating fluid spouted from a tip of said slot, one of said plates disposed on each of two side ends of said slot for applying the coating fluid to a surface of the support from said slot in a non-pressurized condition in a liquid seal state while scraping off part of a viscous fluid previously applied to said support by said front edge, wherein a nearest point of a portion of an upper edge of said coating width regulation plate corresponding to said slot with respect to the support surface is positioned upstream from a center line of a width of said slot along the support running direction and an area given by a product of a distance between the nearest point and the support surface and the width of said slot is 1 $mm^2$ to $6\times10^{-5}$ $mm^2$.

13. The coating equipment as claimed in claim 12, wherein the nearest point of said coating width regulation plate is positioned adjacent to an end wall of said front edge opposite said back edge, and said coating width regulation plate has a surface having a linear slant from the nearest point to an end wall of said back edge opposite said front edge.

14. The coating equipment as claimed in claim 12, wherein the upper edge of said coating width regulation plate corresponding to said slot is planar and parallel to the support surface.

15. The coating equipment as claimed in claim 12, wherein the nearest point of said coating width regulation plate is positioned upstream from the center line and the upper edge of said coating width regulation plate is formed as a curve with an offset crest with the nearest point as a curve vertex.

16. The coating equipment as claimed in claim 12, wherein the nearest point of said coating width regulation plate is positioned upstream from the center line and the upper edge of said coating width regulation plate is formed as a curve having the nearest point as a vertex and advances toward said support surface.

17. The coating equipment of claim 12, wherein a width of said slot is set in said range of 1 mm to 0.1 mm.

18. The coating equipment of claim 12, wherein a value of said distance is set to 10 mm to $3\times10^{-4}$ mm.

19. The coating equipment of claim 12, wherein said area is set within a range of 0.1 $mm^2$ to $1.2\times10^{-4}$ $mm^2$.

20. The coating equipment of claim 12, wherein said area is set within a range of $8\times10^{-3}$ $mm^2$ to $1\times10^{-3}$ $mm^2$.

* * * * *